United States Patent [19]

Howell

[11] 4,173,163

[45] Nov. 6, 1979

[54] TONE GENERATOR FOR ELECTRONIC ORGAN

[75] Inventor: Stephen L. Howell, Jasper, Ind.

[73] Assignee: Kimball International, Inc., Jasper, Ind.

[21] Appl. No.: 813,826

[22] Filed: Jul. 8, 1977

[51] Int. Cl.[2] ..... G10H 5/06

[52] U.S. Cl. ..... 84/1.01; 84/DIG. 11

[58] Field of Search ..... 84/1.01, 1.03, 1.17, 84/1.24, 1.25, DIG. 4, DIG. 5, DIG. 11, DIG. 12, DIG. 25

[56] References Cited

U.S. PATENT DOCUMENTS

| | | | |
|---|---|---|---|
| 3,795,754 | 3/1974 | Mochida | 84/1.01 |
| 3,809,787 | 5/1974 | Mochida | 84/1.01 |
| 3,840,689 | 10/1974 | Nakada | 84/1.01 |
| 4,055,103 | 10/1977 | Machanian | 84/1.01 |

*Primary Examiner*—Stanley J. Witkowski
*Attorney, Agent, or Firm*—Albert L. Jeffers; John F. Hoffman

[57] ABSTRACT

A method and apparatus for generating tones for an electronic organ in which a number of oscillators less than the tones in a scale are provided with the outputs thereof divided by selected divisors to produce a range of frequencies related to one another as the tones of the chromatic scale. The range of frequencies thus developed can be employed as, for example, the top octave for one or more of the organ keyboards and divided down to produce pitches corresponding to other octaves of the keyboards.

6 Claims, 3 Drawing Figures

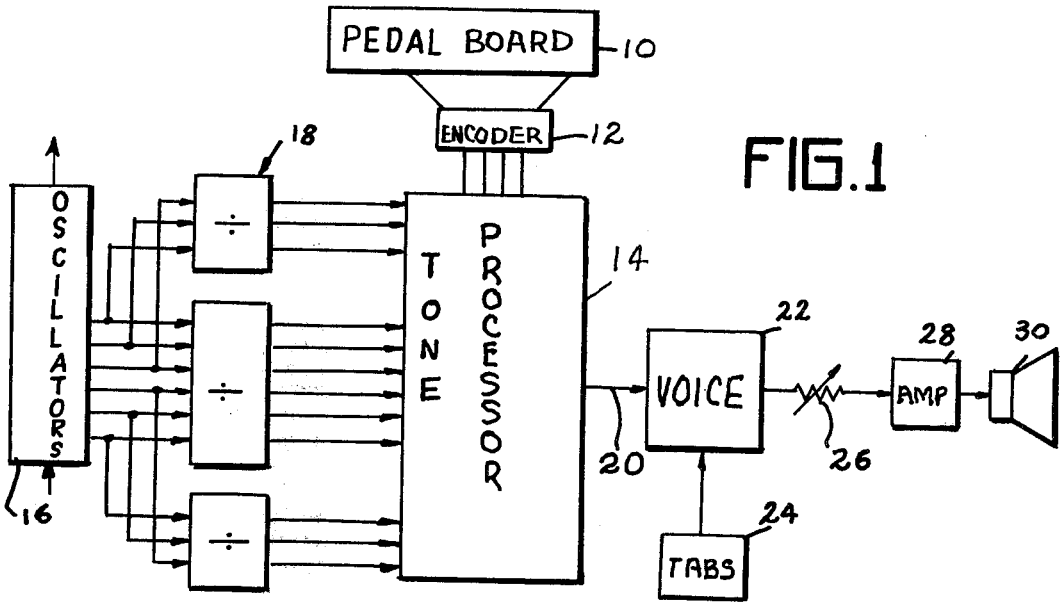
FIG. 1
FIG. 2
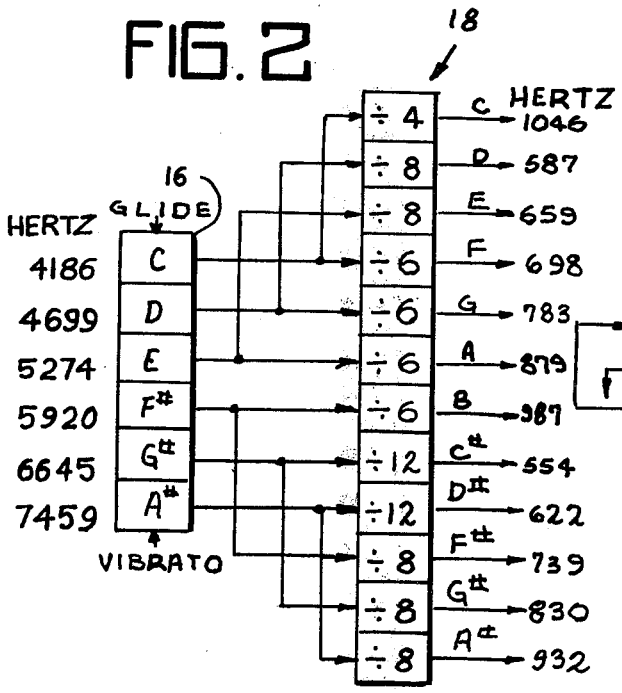
FIG. 3
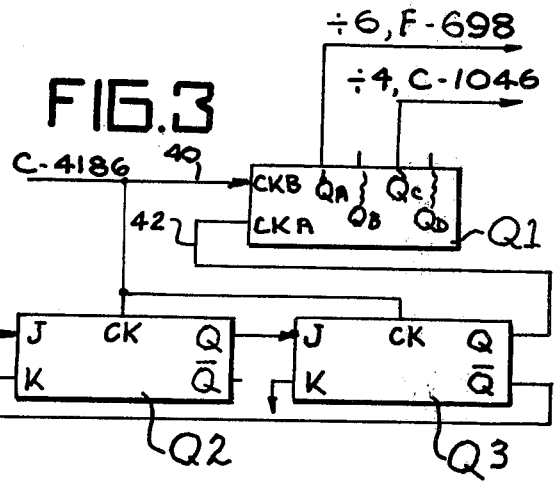

TONE GENERATOR FOR ELECTRONIC ORGAN

BACKGROUND OF THE INVENTION

The present invention relates to the generation of tones or pitches for an electronic organ and is particularly concerned with a novel and simplified arrangement for obtaining the range of pitches necessary.

Most organs, at the present time, have one or the other of two types of tone or pitch generating systems incorporated therein. In one of the systems, twelve separate oscillators are provided, usually with associated circuitry for obtaining vibrato and the like. The other of the systems utilizes what is referred to as a top octave synthesizer, and which produces a range of pitches corresponding to the pitches employed in the uppermost octave of the instrument.

The top octave synthesizer generally employs a single high frequency precision oscillator, the frequency of which is divided down through a rather long divider chain arrangement to arrive at the pitches desired for the top octave.

The main disadvantage to the first mentioned system, in which twelve separate oscillators are employed, is that each oscillator must be tuned separately, not only in production of the organ, but also when the organ is tuned in the field. The tuning of such an organ is thus a complex and time consuming operation.

In the second mentioned system, namely, the system employing the top octave synthesizer, the problem of tuning twelve oscillators is eliminated, but the system is still quite expensive and involves an expensive precision master oscillator to obtain reliable results. The present day tendency toward embodying circuitry in large scale integrated chips presents problems in both of the systems referred to above.

The problems encountered in using a large scale integrated chip system are that pins provided for connections to the chip and the space available on the chip are both at a premium. When twelve separate oscillators are employed, twelve of the available pins, usually forty, of the chips are taken up thereby.

Fewer pins of the chip are required when using the top octave synthesizer system which is embodied directly in the chip, but the problem then presents itself that the top octave synthesizer is relatively large and develops considerable heat so that such a system embodied on a large scale integrated chip is also less than completely satisfactory.

With the foregoing in mind, a primary objective of the present invention is to eliminate the difficulties and problems referred to above.

In particular, an object of the present invention is to provide a pitch or tone generating system for an electronic organ which is less expensive than a top octave synthesizer system and which does not present the tuning problems that are encountered in connection with a more or less conventional twelve oscillator generating system.

A still further object is the provision of circuitry of the nature referred to which can easily be integrated in a large scale integrated chip and does not use an unreasonable number of the pins thereof and which circuitry can be connected with other circuitry which is smaller and which operates at a lower frequency than would be encountered in, for example, a top octave synthesizer system.

BRIEF SUMMARY OF THE INVENTION

According to the present invention, a tone generator is provided for an electronic organ in which a reduced number of oscillators, say, six in number, are provided with the oscillators being tuned to about the pitch of alternate ones of the tones of the scale being employed in an electronic organ, ordinarily, the chromatic scale.

The oscillators supply a bank of frequency dividers which effect division of the frequencies by multiples of two, whereby twelve output frequencies which are related to one another substantially the same as the tones of a chromatic scale are provided. The range of frequencies thus provided can form the top octave for any of the keyboards of the organ and can be divided down to steps of two to provide for frequencies of the other octaves of the keyboard.

It is particularly advantageous to employ the tone generator according to the present invention for generating the tones for the pedal clavier of the organ because it then becomes possible to modify the tone signals employed for the solo and accompaniment keyboards, such as by imparting vibrato thereto, without changing the characteristics of the pedal tones of the organ. Musically, such division of at least the pedal tones from the accompaniment and solo tones is desirable.

The exact nature of the present invention will become more clearly apparent upon reference to the following detailed specification taken in connection with the accompanying drawings in which:

BRIEF DESCRIPTION OF THE DRAWINGS

FIG. 1 is a schematic view showing an electronic organ embodying a generator according to the present invention.

FIG. 2 is a view showing the tone generator section of FIG. 1.

FIG. 3 is a still further schematic view showing one arrangement for dividing an oscillator output down to a pair of desired frequencies.

DETAILED DESCRIPTION OF THE INVENTION

Referring to the drawings somewhat more in detail, and in particular to FIG. 1, a portion of an organ circuit is somewhat schematically illustrated therein. In FIG. 1, reference numeral 10 represents the pedal board or pedal clavier of an organ, although it will be understood that reference numeral 10 could refer to any one of the keyboards of the organ.

The pedal board comprises individual keys which are connected via an encoder 12 to provide a digital input to a tone processor 14 with the digital input representing the particular pedal of pedal board 10 which is depressed. Processor 14 also receives an input from the tone generator of the present invention, and the tone generator comprises a bank of six oscillators generally indicated at 16 which supply dividers generally indicated at 18 and which dividers supply twelve tones or pitches as inputs to processor 14.

Processor 14 is not illustrated in detail and may comprise any sort of processing arrangement for dealing with the pitch inputs to component 14 in conformity with the digital input from pedal board 10 and in further conformity with selections which have been made by the player. For example, the processor 14 could supply to output 20 thereof simple tone signals in conformity with the respective pedal of pedal board 10 which is depressed.

Alternatively, processor 14 could develop rhythmic note patterns or the like. All of these possibilities are known in the art and the particular manner in which the tone inputs to processor 14 are processed form no part of the present invention.

Examples of suitable circuitry for component 14 are U.S. Pat. Nos. 4,020,728 and 3,916,750.

Output 20 is supplied as an input to voicing ciruitry 22 under the control of tabs 24 with the output of the voicing circuitry 22 being supplied through volume control element 26 and amplifier means 28 to speaker means 30.

FIG. 2 shows more in detail the tone generating system. The tone generating system is arranged to supply the top octave in the 8 foot range for the accompaniment keyboard. The frequencies which are developed can be divided, as mentioned, to provide the frequencies necessary for the other octaves and other footages of the pedal keyboard according to practices known in the art.

In FIG. 2, the oscillator bank at 16 will be seen to comprise oscillators identified at C, D, E, F#, G# and A#. The frequencies provided by the oscillators are, as marked on the drawing, and commencing with the C oscillator, 4186 hertz, 4699 hertz, 5274 hertz, 5920 hertz, 6645 hertz and 7459 hertz, respectively. Oscillators 16 oscillate at frequencies which are related substantially the same as the frequencies of alternate tones of the chromatic scale.

The output from the C oscillator is divided by a divide by four divider in the divider bank 18 to provide an output at 1046 hertz and is also divided by six by a further divider means to provide an output of 698 hertz. The first mentioned frequency corresponds to the C at the top of the upper octave of the accompaniment manual corresponding to 8 feet and the second mentioned frequency corresponds generally to the F frequency beneath the C. The F frequency referred to is not precisely in tune, but the amount of out of tune of the various tones is not considered to be musically significant.

The output for the D oscillator is divided by eight to produce an output of 587 hertz and is also divided by six to provide an output of 783 hertz. The output of the E oscillator is similarly divided by eight and six to provide outputs of 659 hertz and 879 hertz, respectively. The output of the F# oscillator is also divided by six and eight to produce the frequencies marked on the drawing while the output of the G# and A# oscillators also are each divided by twelve and eight as shown.

From FIG. 2, it will be seen that the divided down outputs of the oscillators produce twelve pitches substantially corresponding to the 8 foot pitches pertaining to the upper octave of the accompaniment keyboard. The twelve pitches supplying outputs from divider bank 18 range from 554 hertz, corresponding to C#, up to 1046 hertz, corresponding to C.

A simple manner of obtaining the divided down tones is shown in FIG. 3 and wherein wire 40 represents the output from the C oscillator. The 4186 hertz supply on wire 40 is connected to the clock B input of Q1 and the clocking input of Q2 and also to the clocking input of Q3.

In FIG. 3, Q1 is a binary counter identified in the 1973 TTL Data Book from Texas Instruments under Number 7493 while Q2 and Q3 are flip flops identified in the same data book under Number 74107.

As is well known, with the J terminal of Q2 connected to the Q terminal of Q3 and with the Q terminal of Q2 connected to the J terminal of Q3. The frequency of the output from Q3 at the Q terminal thereof on wire 42 is one-third the frequency on wire 40 and is supplied to clock terminal A of component Q1.

With the circuitry connected in the manner shown, the output of terminal QA of component Q1 is at an F frequency of 698 hertz which is about one-sixth of the frequency on line 40. Another output taken from the QC terminal of Q1 represents the frequency on line 40 divided by four and is thus at a C frequency of 1046 hertz.

The circuit arrangement of FIG. 3 can be employed in connection with any of the oscillator outputs of FIG. 2 and the addition of one or more divide by two dividers can be employed to produce any of the dividing ratios identified on the divider bank 18 in FIG. 2.

From the foregoing, it will be seen that an extremely simple arrangement is provided for obtaining a desired octave range of frequencies. Everything illustrated in FIG. 2, for example, could be implemented in a large scale integrated chip except for the oscillator group at 16. Only six pins are required for connecting the oscillators to the chip and which chip contains internal dividers for making up a complete tone generating system.

As mentioned, the illustrated arrangement supplies 8 foot pitch for the top octave of the accompaniment manual, but an increase in the frequency of the inputs from the group of oscillators would provide for a higher pitch in the twelve output tones and the arrangement illustrated could, accordingly, be employed for either the accompaniment keyboard or the solo keyboard.

As mentioned, it will be noted that substantially less time is required to tune six oscillators than is required to tune twelve as are conventionally employed. A substantial cost savings is also realized. The circuitry associated with the oscillators is cheaper to incorporate in an integrated circuit than a top octave synthesizer because of size while only six pins are required to accommodate the tone inputs of such a chip.

As also mentioned, the present invention offers the possibility of providing separate generating systems, especially for the pedal keyboard, at relatively low cost. With such separation of the tone generating system of one keyboard from another, independent vibrato and glide and other tonal effects can be provided selectively for the keyboards.

The present invention also reduces the complications which come about when it is attempted to make vibrato and glide shift and the like uniform for an entire range of oscillators because of the reduced number of oscillators employed in the present invention.

Modifications may be made within the scope of the appended claims.

What is claimed is:

1. The method of generating tone frequencies for musical purposes, especially for use in electronic organs, which comprises: generating six input frequencies which are related in frequency substantially as selected diverse tones of the chromatic scale, dividing each frequency by a factor of a whole number multiple of four and by a factor of a whole number multiple of six to produce two respective output frequencies corresponding to the respective input frequency thereby providing a set of twelve said output frequencies related in frequency substantially as the corresponding tones of the chromatic scale of one octave, each of said output frequencies being a substantially symmetrical wave form.

2. The method according to claim 1 in which said generated frequencies are related in frequency as alternate ones of the tones of the chromatic scale.

3. The method according to claim 2 which includes dividing the said set of output frequencies to obtain further sets of frequencies for each of several consecutive octaves.

4. A tone generation system comprising: six oscillators oscillating at respective diverse frequencies, six pairs of frequency divider means connected to the outputs of the respective six oscillators and providing output frequencies corresponding to the respective tones of the chromatic scale, one of said divider means in each of said pairs dividing by a factor of a whole number multiple of four and the other divider means in each of said pairs dividing by a factor of a whole number multiple of six so as to provide substantially symmetrical wave forms, said output frequencies in number being equal to or greater than the number of notes in the chromatic scale of one octave.

5. A tone generator according to claim 4 in which said oscillators oscillate at frequencies which are related substantially the same as the frequencies of alternate tones of the chromatic scale.

6. A tone generator according to claim 4 in which the frequencies at the outputs of said divider means form a set of frequencies corresponding to at least one of the sets of frequencies pertaining to the top octave of a manual of an electronic organ.

* * * * *

UNITED STATES PATENT AND TRADEMARK OFFICE

CERTIFICATE OF CORRECTION

PATENT NO. : 4,173,163

DATED : November 6, 1979

INVENTOR(S) : STEPHEN L. HOWELL

It is certified that error appears in the above-identified patent and that said Letters Patent are hereby corrected as shown below:

Column 4, line 4, change "Q" to --$\overline{Q}$--.

Column 4, line 57, the following paragraph should be inserted between lines 51 and 52: --Due to the low cost of the generator according to the present invention, the possibility also presents itself of having two complete tone generating systems to provide for Celeste effect, for example. Certain special effects which result from detuning of one set of tone signals from another can also be realized by using two sets of oscillators.--

Signed and Sealed this

*Twenty-fifth* Day of *March 1980*

[SEAL]

*Attest:*

SIDNEY A. DIAMOND

*Attesting Officer*

*Commissioner of Patents and Trademarks*